US006267685B1

(12) United States Patent
Cannon

(10) Patent No.: US 6,267,685 B1
(45) Date of Patent: Jul. 31, 2001

(54) BILLIARDS CUE STROKE GUIDANCE AID

(76) Inventor: David H. G. Cannon, 41 Surbiton Road, Camberley, GU15 4BN (GB)

( * ) Notice: Subject to any disclaimer, the term of this patent is extended or adjusted under 35 U.S.C. 154(b) by 0 days.

(21) Appl. No.: 09/307,345

(22) Filed: May 6, 1999

(51) Int. Cl.[7] ..... A63D 15/10
(52) U.S. Cl. ..... 473/42; 473/2
(58) Field of Search ..... 473/1, 2, 42

(56) References Cited

U.S. PATENT DOCUMENTS 898,345 * 9/1908 Farnham ..... 473/42
4,053,153 * 10/1977 Josenhans ..... 473/43
5,238,457 * 8/1993 Triplett ..... 473/42
5,295,682 * 3/1994 Leonard ..... 473/42
5,846,137 * 12/1998 Tremblay ..... 473/42
5,853,333 * 12/1998 Patterson ..... 473/42

* cited by examiner

*Primary Examiner*—Jeanette Chapman
*Assistant Examiner*—M. Chambers

(57) ABSTRACT

A billiards cue stroke guidance aid for supporting a billiard cue when performing a stroke or shot in a billiards game. The billiards cue stroke guidance aid includes a base and a support upwardly extending from the base. The support has a guide hole therethrough. A generally V-shaped upper guide is upwardly extended from an upper end of the support.

1 Claim, 2 Drawing Sheets

BILLIARDS CUE STROKE GUIDANCE AID

BACKGROUND OF THE INVENTION

1. Field of the Invention

The present invention relates to billiard accessories and more particularly pertains to a new billiards cue stroke guidance aid for supporting a billiard cue when performing a stroke or shot in a billiards game.

2. Description of the Prior Art

The use of billiard accessories is known in the prior art. More specifically, billiard accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,372,929 by Molis; 3,836,145 by Frejd; 87,566 by Hill; 5,449,325 by Dransfield et al.; 4,147,346 by Giannetti; and 312,290 by Rodriguez.

While these devices fulfill their respective, particular objectives and requirements, the aforementioned patents do not disclose a new billiards cue stroke guidance aid. The inventive device includes a base and a support upwardly extending from the base. The support has a guide hole therethrough. A generally V-shaped upper guide is upwardly extended from an upper end of the support.

In these respects, the billiards cue stroke guidance aid according to the present invention substantially departs from the conventional concepts and designs of the prior art, and in so doing provides an apparatus primarily developed for the purpose of supporting a billiard cue when performing a stroke or shot in a billiards game.

SUMMARY OF THE INVENTION

In view of the foregoing disadvantages inherent in the known types of billiard accessories now present in the prior art, the present invention provides a new billiards cue stroke guidance aid construction wherein the same can be utilized for supporting a billiard cue when performing a stroke or shot in a billiards game.

The general purpose of the present invention, which will be described subsequently in greater detail, is to provide a new billiards cue stroke guidance aid apparatus and method which has many of the advantages of the billiard accessories mentioned heretofore and many novel features that result in a new billiards cue stroke guidance aid which is not anticipated, rendered obvious, suggested, or even implied by any of the prior art billiard accessories, either alone or in any combination thereof.

To attain this, the present invention generally comprises a base and a support upwardly extending from the base. The support has a guide hole therethrough. A generally V-shaped upper guide is upwardly extended from an upper end of the support.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new billiards cue stroke guidance aid apparatus and method which has many of the advantages of the billiard accessories mentioned heretofore and many novel features that result in a new billiards cue stroke guidance aid which is not anticipated, rendered obvious, suggested, or even implied by any of the prior art billiard accessories, either alone or in any combination thereof.

It is another object of the present invention to provide a new billiards cue stroke guidance aid which may be easily and efficiently manufactured and marketed.

It is a further object of the present invention to provide a new billiards cue stroke guidance aid which is of a durable and reliable construction.

An even further object of the present invention is to provide a new billiards cue stroke guidance aid which is susceptible of a low cost of manufacture with regard to both materials and labor, and which accordingly is then susceptible of low prices of sale to the consuming public, thereby making such billiards cue stroke guidance aid economically available to the buying public.

Still yet another object of the present invention is to provide a new billiards cue stroke guidance aid which provides in the apparatuses and methods of the prior art some of the advantages thereof, while simultaneously overcoming some of the disadvantages normally associated therewith.

Still another object of the present invention is to provide a new billiards cue stroke guidance aid for supporting a billiard cue when performing a stroke or shot in a billiards game.

Yet another object of the present invention is to provide a new billiards cue stroke guidance aid which includes a base and a support upwardly extending from the base. The support has a guide hole therethrough. A generally V-shaped upper guide is upwardly extended from an upper end of the support.

Still yet another object of the present invention is to provide a new billiards cue stroke guidance aid that allows disabled users, especially users with only one arm or a user that is not able to bend down, to play billiards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
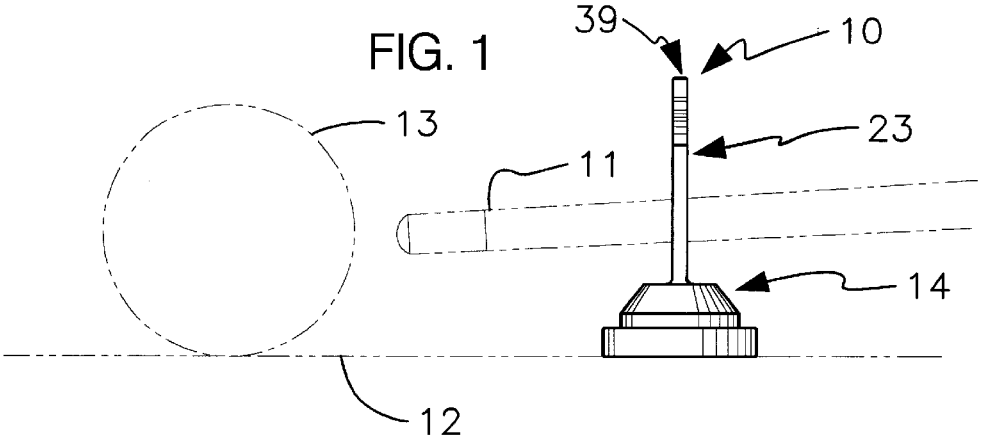
FIG. 1 is a schematic side view of a new billiards cue stroke guidance aid in use according to the present invention with a cue extended through the guide hole.

With reference now to the drawings, and in particular to FIGS. 1 through 5 thereof, a new billiards cue stroke guidance aid embodying the principles and concepts of the present invention and generally designated by the reference numeral 10 will be described.

As best illustrated in FIGS. 1 through 5, the billiards cue stroke guidance aid 10 generally comprises a base and a support upwardly extending from the base. The support has a guide hole therethrough. A generally V-shaped upper guide is upwardly extended from an upper end of the support.

Figure 2:
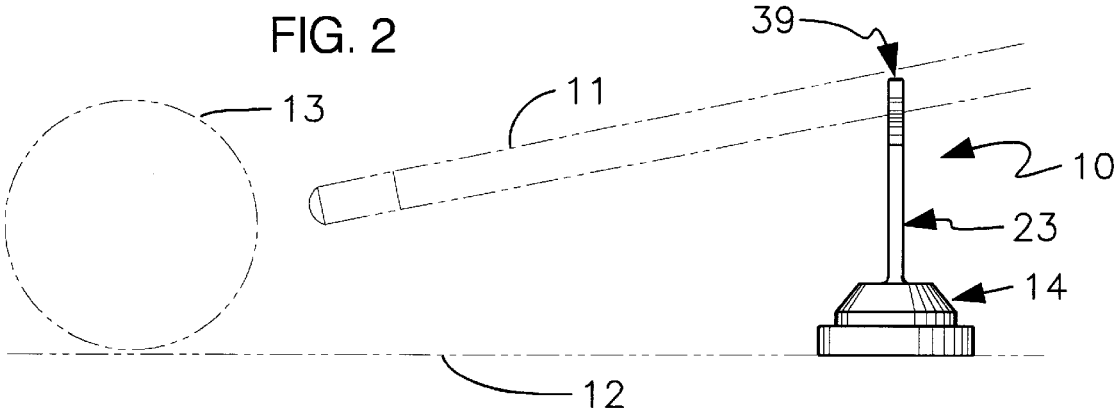
FIG. 2 is a schematic side view of the present invention in use with a cue extended between the arms of the upper guide.

In use, the billiards cue stroke guidance aid 10 is designed for supporting an end of a billiards cue 11 on a billiards table 12 so that a user may strike a billiard ball 13 on the billiards table as illustrated in FIGS. 1 and 2. In closer detail, the billiards cue stroke guidance aid includes a base 14 for resting on a playing surface of a billiards table. The base preferably has a generally disk-shaped lower portion 15 and a generally frusto-conical upper portion 16. The upper and lower portions of the base are preferably substantially coaxial with one another.

The lower portion of the base has generally circular upper and lower faces 17,18, and a generally cylindrical outer side 19 between the upper and lower faces of the lower portion. Preferably, the upper and lower faces of the lower portion lie in generally parallel planes with one another. The lower portion of the base has a height defined between the upper and lower faces of the lower portion and a outer diameter defined across the outer side of the lower portion. Ideally, the height of the lower portion of the base is about 10 mm, and the outer diameter of the lower portion of the base is about 50 mm.

The upper portion of the base tapers upwards from the lower portion of the base. The upper portion of the base preferably has a generally disk-shaped lower region 20, and a generally frusto-conical upper region 21 terminating at a substantially planar generally circular top face 22. Preferably, the top face of the upper portion lies in a plane generally parallel with the upper and lower faces of the lower portion. The lower region of the upper portion of the base has a height defined upwardly from the upper face of the lower portion. The upper region of the upper portion of the base has a height defined between the lower region and the top face of the upper portion. Ideally, the height of the lower region of the upper portion is about 5 mm and the height of the upper region of the upper portion is about 10 mm. The lower region and the top face of the upper portion each has an outer diameter. Preferably, the outer diameter of the top face of the upper portion is less than the outer diameter of the lower region of the upper portion and the outer diameter of the lower region of the upper portion is less than the outer diameter of the lower portion of the base.

A support 23 upwardly extends from the top face of the upper portion of the base. The support has a pair of generally planar and parallel faces 24,25, opposite upper and lower ends 26,27, and a pair of substantially straight sides 28,29 extending between the upper and lower ends of the support. Preferably, the faces of the support lie in generally perpendicular planes to the top face of the upper portion of the base so that the faces of the support are vertically extended when the base is rested on a horizontal surface.

The lower end of the support is integrally coupled to the top face of the upper portion of the base. The sides of the support are extended generally perpendicular to the top face of the upper portion of the base. The upper end of the support is generally curved with a downwardly facing concavity extending between the sides of the support. The support has a thickness defined between the faces of the support, a height defined between the upper and lower ends of the support, and a width defined between the sides of the support. Ideally, the thickness of the support is about 4.5 mm, the height of the support is about 68 mm, and the width of the support is substantially equal to the outer diameter of the top face of the upper portion of the base.

The support has a guide hole 30 therethrough between the faces of the support. In use, the guide hole is designed for extending an end of billiards cue therethrough as illustrated in FIG. 1. Preferably, the guide hole has a generally inverted-U-shaped upper periphery 31 and a generally V-shaped lower periphery 32 connected to the upper periphery of the guide hole.

The upper periphery of the guide hole has a spaced apart pair of substantially parallel and straight side regions 33,34 and an arcuate top region 35 connecting the side regions of the upper periphery together. The top region of the upper periphery is positioned adjacent the upper end of the support. One of the side regions of the upper periphery is positioned adjacent one of the sides of the support. The other of the side regions of the upper periphery is positioned adjacent the other of the sides of the support.

The side regions of the upper periphery are preferably extended generally parallel to the sides of the support. Ideally, the side regions of the upper periphery are generally evenly spaced apart from the associated adjacent sides of the support so that the space between one side region and its associated adjacent side is equal to the space between the other side region and its associated adjacent side.

The lower periphery of the guide hole has a pair of side portions 36,37 downwardly converging together at a rounded lower vertex 38 of the lower periphery. One of the side portions of the lower periphery is connected to one of the side regions of the upper periphery. The other of the side portions of the lower periphery is connected to the other of the side regions of the upper periphery. In use, the lower vertex of the lower periphery is designed for resting a billiards cue is extended through the guide hole. The lower vertex of the lower periphery is rounded and has an upwardly facing concavity.

Figure 4:
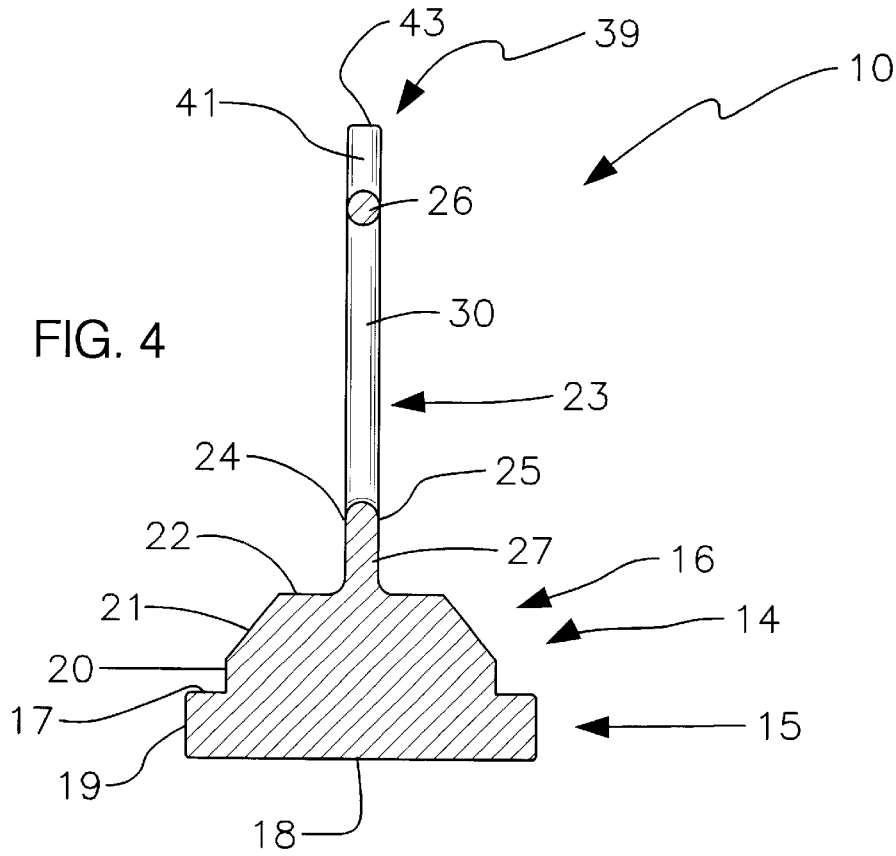
FIG. 4 is a schematic cross sectional view of the present invention taken from line 4—4 of FIG. 3.
Figure 5:
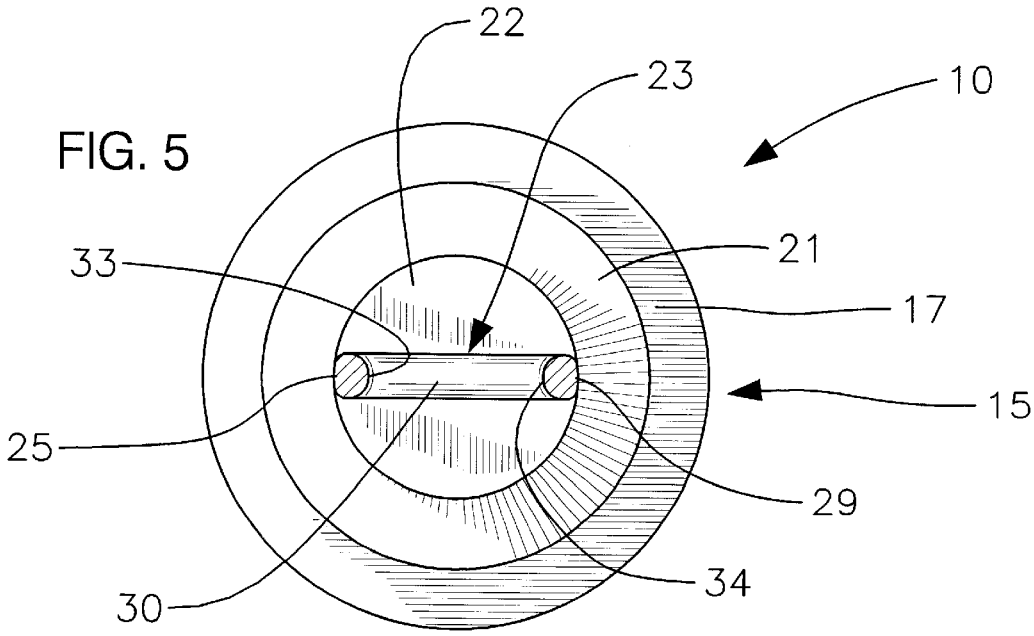
FIG. 5 is a schematic transverse cross sectional view of the present invention taken from line 5—5 of FIG. 3.

As best illustrated in FIGS. 4 and 5, the upper and lower peripheries of the guide hole each preferably have a round transverse cross section with the transverse cross sections of the upper and lower peripheries of the guide hole each has a convexity facing into the guide hole. The guide hole has a length defined between the top region portion of the upper periphery and the lower vertex of the lower periphery. The guide hole has a width defined between the side regions of the upper periphery. Ideally, the length of the guide hole is about 46 mm and the width of the guide hole is about 18 mm.

A generally V-shaped upper guide 39 is upwardly extended from the upper end of the support. The upper guide has a pair of arms 40,41 upwardly extending from the upper end of the support. The arms converge towards one another in a downwards direction towards the upper end of the support. Ideally, the arms of the upper guide each have a generally circular transverse cross section.

The arms of the upper guide are extended from one another at an angle less than about 180 degrees. Preferably, the angle between the arms of the upper guide is less than about 90 degrees. Ideally, the angle between the arms of the upper guide is about 70 degrees.

Figure 3:
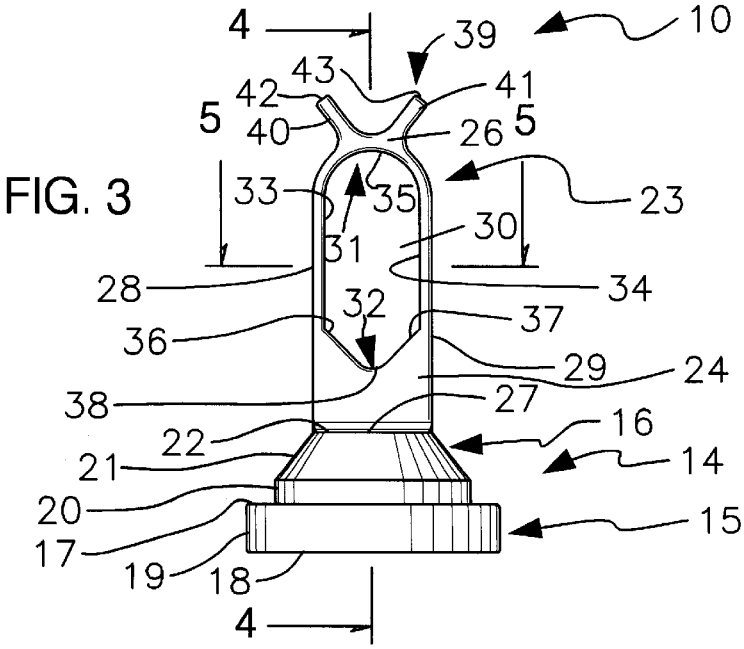
FIG. 3 is a schematic front view of the present invention.

The arms of the upper guide each terminate at a free end 42,43 opposite the upper end of the support. As best illustrated in FIG. 3, preferably, the free end of one of the arms lies along a common line with one of the sides of the support and the free end of the other of the arms lies along a common line with the other of the sides of the support.

The upper guide has a height defined between the upper end of the support and a generally horizontal line extending between the free ends of the arms. Ideally, the height of the upper guide is about 4.5 mm.

The upper guide defines a generally V-shaped space designed for extending an end of a billiards cue therethrough as illustrated in FIG. 2. The space of the upper guide has a pair of substantially straight sides defined by the arms of the upper guide, and a rounded lower vertex connecting the sides of the spaced of the upper guide together. The rounded lower vertex of the space of the upper guide is designed for resting thereon a billiards cue extending through the space of the upper guide.

Ideally, the aid is made from a metal material such as brass or stainless steel so that it has enough weight to support a cue and remain upright on a billiards table.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A support aid for supporting an end of a billiards cue on a billiards table, said support aid comprising:

a base for resting on a surface, said base having a generally disk-shaped lower portion and a generally frusto-conical upper portion;

said upper and lower portions of said base being substantially coaxial with one another;

said lower portion of said base having generally circular upper and lower faces, and a generally cylindrical outer side between said upper and lower faces of said lower portion;

said upper and lower faces of said lower portion lying in generally parallel planes with one another;

said lower portion of said base having a height defined between said upper and lower faces of said lower portion and a outer diameter defined across said outer side of said lower portion;

said upper portion of said base tapering upwards from said lower portion of said base;

said upper portion of said base having a generally disk-shaped lower region, and a generally frusto-conical upper region terminating at a substantially planar generally circular top face;

said top face of said upper portion lying in a plane generally parallel with said upper and lower faces of said lower portion;

said lower region of said upper portion of said base having a height defined upwardly from said upper face of said lower portion;

said upper region of said upper portion of said base having a height defined between said lower region and said top face of said upper portion;

said lower region and said top face of said upper portion each having an outer diameter;

said outer diameter of said top face of said upper portion being less than said outer diameter of said lower region of said upper portion, said outer diameter of said lower region of said upper portion being less than said outer diameter of said lower portion of said base;

a support upwardly extending from said top face of said upper portion of said base;

said support having a pair of generally planar faces, opposite upper and lower ends, and a pair of substantially straight sides extending between said upper and lower ends of said support;

said faces of said support lying in generally perpendicular planes to said top face of said upper portion of said base;

said lower end of said support being coupled to said top face of said upper portion of said base;

said sides of said support being extended generally perpendicular to said top face of said upper portion of said base;

said upper end of said support being generally curved and having a downwardly facing concavity extending between said sides of said support;

said support having a thickness defined between said faces of said support, a height defined between said upper and lower ends of said support, and a width defined between said sides of said support;

said width of said support being substantially equal to said outer diameter of said top face of said upper portion of said base;

said support having a guide hole therethrough between said faces of said support, said guide hole being adapted for extending an end of billiards cue therethrough;

said guide hole having a generally inverted-U-shaped upper periphery and a generally V-shaped lower periphery connected to said upper periphery of said guide hole;

said upper periphery of said guide hole having a spaced apart pair of substantially parallel and straight side regions and an arcuate top region connecting said side regions of said upper periphery together;

said top region of said upper periphery being positioned adjacent said upper end of said support, one of said side regions of said upper periphery being positioned adjacent one of said sides of said support, the other of said side regions of said upper periphery being positioned adjacent the other of said sides of said support;

said side regions of said upper periphery being extended generally parallel to said sides of said support;

said side regions of said upper periphery being generally evenly spaced apart from the associated adjacent sides of said support;

said lower periphery of said guide hole having a pair of side portions downwardly converging together at a lower vertex of said lower periphery;

one of said side portions of said lower periphery being connected to one of said side regions of said upper periphery, the other of said side portions of said lower periphery being connected to the other of said side regions of said upper periphery;

said lower vertex of said lower periphery being adapted for resting a billiards cue being extended through said guide hole;

said lower vertex of said lower periphery being rounded and having an upwardly facing concavity;

said upper and lower peripheries of said guide hole each having a round transverse cross section, said transverse cross sections of said upper and lower peripheries of said guide hole each having a convexity facing into said guide hole;

said guide hole having a length defined between said top region portion of said upper periphery and said lower vertex of said lower periphery;

said guide hole having a width defined between said side regions of said upper periphery;

a generally V-shaped upper guide being upwardly extending from said upper end of said support;

said upper guide having a pair of arms upwardly extending from said upper end of said support, said arms converging towards one another in a downwards direction towards said upper end of said support;

said arms of said upper guide each having a generally circular transverse cross section;

said arms of said upper guide being extended from one another at an angle less than about 90 degrees;

said arms of said upper guide each terminating at a free end opposite said upper end of said support, said free end of one of said arms lying along a common line with one of said sides of said support, said free end of the other of said arms lying along a common line with the other of said sides of said support;

said upper guide having a height defined between said upper end of said support and a line extending between said free ends of said arms;

said upper guide defining a generally V-shaped space adapted for extending an end of a billiards cue therethrough;

said space of said upper guide having a pair of substantially straight sides defined by said arms of said upper guide, and a rounded lower vertex connecting said sides of said spaced of said upper guide together; and said rounded lower vertex of said space of said upper guide being adapted for resting thereon a billiards cue extending through said space of said upper guide.

* * * * *